US012708210B2

(12) United States Patent
Salzmann

(10) Patent No.: US 12,708,210 B2
(45) Date of Patent: Aug. 18, 2026

(54) SITTING OR LYING FURNITURE

(71) Applicant: Krall+Roth Services GmbH & Co. KG, Moenchengladbach (DE)

(72) Inventor: Oliver Salzmann, Willich (DE)

(73) Assignee: Krall+Roth Services GmbH & Co. KG, Moenchengladbach (DE)

( * ) Notice: Subject to any disclaimer, the term of this patent is extended or adjusted under 35 U.S.C. 154(b) by 153 days.

(21) Appl. No.: 18/680,063

(22) Filed: May 31, 2024

(65) Prior Publication Data

US 2024/0398120 A1 Dec. 5, 2024

(30) Foreign Application Priority Data

May 31, 2023 (DE) ..... 102023114299.2

(51) Int. Cl.

| | |
|---|---|
| ***A47C 4/02*** | (2006.01) |
| ***D04B 21/20*** | (2006.01) |
| *A45F 3/24* | (2006.01) |
| *A47C 1/14* | (2006.01) |

(52) U.S. Cl.

CPC ..... *A47C 4/028* (2013.01); *D04B 21/202* (2013.01); *A45F 3/24* (2013.01); *A47C 1/143* (2013.01)

(58) Field of Classification Search

CPC ..... A47D 13/107; A45F 3/24; A47C 1/143; A47C 1/14; A47C 4/06; A47C 4/30; A47C 4/028; A47C 5/06

See application file for complete search history.

(56) References Cited

U.S. PATENT DOCUMENTS

| | | | | |
|---|---|---|---|---|
| 3,981,538 A * | 9/1976 | Chubb | ..... | A47C 7/282 D6/373 |
| 6,783,183 B2 * | 8/2004 | Tseng | ..... | A47C 4/02 297/440.11 |
| 7,416,248 B2 * | 8/2008 | Rojas | ..... | A47C 7/383 297/283.2 |

FOREIGN PATENT DOCUMENTS

WO WO-2023017300 A1 * 2/2023 ..... A47C 13/005

* cited by examiner

*Primary Examiner* — Syed A Islam

(74) *Attorney, Agent, or Firm* — Von Rohrscheidt Patents

(57) ABSTRACT

A piece of sitting or lying furniture including a support frame; an operating device configured for a user to sit on, lie on or lean against, wherein the operating device includes a self-supporting main textile part configured to react forces imparted upon the operating device into the support frame self-acting by tensions formed in the main textile part, wherein the main textile part is configured as a flat contexture, wherein the operating device includes at least one auxiliary unit group including at least two auxiliary units which are directly and jointly connected with at least one edge of the main textile part at least in sections, so that the main textile part is directly supported at the at least two auxiliary units.

14 Claims, 5 Drawing Sheets

SITTING OR LYING FURNITURE

RELATED APPLICATIONS

This application claims priority German Patent Application DE 10 2023 114 299.2 filed on May 31, 2023 which is incorporated in its entirety by this reference

FIELD OF THE INVENTION

The invention relates to a piece of sitting or lying furniture which can be configured as an office chair, a gaming chair, or a sun lounge chair or similar.

BACKGROUND OF THE INVENTION

Generic pieces of sitting or lying furniture are well known in the art. Furniture using self-supporting textiles has a disadvantage in that seated or recumbent comfort suffers due to a bending of a respective operating device which has to occur as a matter of principle in order to react forces. This can cause a so-called hammock effect which causes a body of a person using the piece of sitting or lying furniture to have a large contact surface with the operating device through which forces are transferred to the body of the person. Thus, the body may contact the operating device with a surface area that reaches up to a lateral portion of the buttocks or the back so that pressure forces impact the body of the user which can be perceived as unpleasant.

BRIEF SUMMARY OF THE INVENTION

Thus, it is an object of the invention to provide a piece of sitting or lying furniture which provides a high level of user comfort in spite of using self-supporting textiles to react forces to a respective support frame.

The object is achieved by a piece of sitting or lying furniture including a support frame; an operating device configured for a user to sit on, lie on or lean against, wherein the operating device includes a self-supporting main textile part configured to react forces imparted upon the operating device into the support frame self-acting by tensions formed in the main textile part, wherein the main textile part is configured as a flat contexture, wherein the operating device includes at least one auxiliary unit group including at least two auxiliary units which are directly and jointly connected with at least one edge of the main textile part at least in sections, so that the main textile part is directly supported at the at least two auxiliary units, wherein the at least two auxiliary units are attached at the support frame so that the main textile part is indirectly supported by the auxiliary units at the support frame, and wherein the at least two auxiliary units run from the at least one edge of the main textile part to different attachment locations at the support frame. Advantageous embodiments can be derived from the dependent claims, the description, and embodiments.

The piece of sitting or lying furniture includes a support frame that supports at least one operating device. Put differently, the operating device is supported at the support frame. The operating device according to the invention is configured and arranged so that a user of the piece of sitting or lying furniture can sit thereon or lie thereon or lean against it when using the piece of sitting or lying furniture. Accordingly the operating device supports the user and can therefore also be designated as a support device. The user can lean against the operating device that is configured e.g. as a back rest of a chair. An operating device for the user to sit on can be formed e.g. by a sitting element, e.g. by a sitting surface of a chair. The operating device can have in particular self-supporting properties and can include at least one self-supporting textile element. Self-supporting in this context means the same as cantilevered, this means an embodiment where the central engineering design element, thus the textile part, performs its load reacting function without additional external load bearing elements.

The support frame can be formed e.g. by one or plural support frame elements, e.g. support tubes that are well known for pieces of sitting furniture in general and other furniture. The support frame can include a base frame that sits on a floor and react forces into the floor. In an office chair the base frame can include a swivel so that a sitting surface and a back rest can be rotated about a vertical axis.

In the piece of sitting or lying furniture according to the invention the operating device includes a self-supported main textile part configured and arranged to react imparted forces into the support frame self-acting. The operating device can provide a sitting surface of a chair which is loaded with forces mostly in a direction orthogonal to a typically horizontally oriented operating device surface when the piece of furniture is being used. Due to these forces, tensile stress is formed in the main textile part. Put differently, the main textile part is tensioned causing support forces at edges of the main textile part which have to be reacted into the support frame by at least one auxiliary unit group to be described infra. The same principle applies for all operating devices, e.g. backrests or lying surfaces. Put differently, the at least one auxiliary unit group connects the main textile part with the support frame or couples the main textile part with the support frame so that forces reacted into the main textile part are at least partially reacted into the support frame by the at least one auxiliary group unit.

The self-acting reaction of forces which is characteristic for self-supporting or cantilevered textile parts means in the context of the instant application that the main textile part is not supported by other force reacting elements or devices at least in a portion of its main textile surface in order to react forces in a direction towards the support frame. Thus, the main textile part is free from additional support structures. This means that forces impacting the main textile part are reacted in a direction towards the support frame exclusively by the main textile part itself.

The main textile part is configured as a flat contexture whose width and length respectively significantly exceed its thickness. The main textile part can be formed e.g. by a woven material, knitted material, or warp knitted fabric. The main textile part can form at least an essential portion of the operating device, e.g. of a sitting surface or backrest surface of a piece of sitting furniture or a lying surface of a piece of lying furniture and can extend over a surface area between frame elements of the respective support frame. In particular, a main textile surface of the main textile part can amount to at least 70%, advantageously at least 75%, further advantageously at least 80% of an entire operating device surface of the operating device.

In addition to the main textile part the operating device according to the invention includes at least one auxiliary unit group including at least two auxiliary units, advantageously exactly two auxiliary units. The auxiliary unit group with its auxiliary units connects the main textile part with the support frame or couples the main textile part with the support frame. This connection can be advantageously configured as a tension connection, wherein the main textile part is tension connected at the support frame by the auxiliary units of the at least one auxiliary unit group. The auxiliary units are connected at least in sections jointly and directly with at least one edge of the main textile part and simultaneously connected with the support frame or attached thereon. Thus, the main textile part is at least partially supported at the support frame by the auxiliary units.

The term auxiliary units according to the instant application is functional and does not relate to physical separation. Thus, an auxiliary unit can be formed by only one physical auxiliary element, e.g. by only one textile part (auxiliary textile), e.g. and advantageously by a flat contexture element, or by plural physically separate auxiliary elements or a plurality of auxiliary elements. The latter can be formed e.g. by individual textile parts or spring elements configured as wire springs. The individual auxiliary elements of the respective auxiliary unit are thus related with each other in that they operate functionally in the same manner, thus jointly cause a similar tension reaction of the main textile part at the support frame, in particular in that they are jointly connected at the same support frame part of the support frame. These auxiliary elements jointly form a respective auxiliary unit or the respective auxiliary unit includes a plurality of identically acting auxiliar elements.

Advantageously the operating device includes a plurality of auxiliary unit groups, wherein plural auxiliary groups can be associated with the same edge of the main textile part and/or can be associated with various edges of the main textile part. Particularly advantageously the operating device includes at least two auxiliary unit groups, advantageously exactly two auxiliary unit groups which are associated with opposite edges of the main textile part which will be described in more detail infra.

A respective auxiliary unit of an auxiliary unit group can be formed by an auxiliary element or a plurality of auxiliary elements respectively forming a flat contexture, wherein the auxiliary elements are connected with respective edges of the main textile part. In this configuration with textile auxiliary units various variants are conceivable.

For example a one-piece flat contexture, e.g. a fabric that is part of the respective operating device can form the main textile part and one or plural auxiliary units of one or plural auxiliary unit groups. The edge of the main textile part in this embodiment does not constitute a physical separation between the main textile part and one or more auxiliary units, but constitutes a functional separation, wherein the edge of the main textile part is defined by the connection of the auxiliary units of the respective auxiliary unit group. The flat contexture can be tensioned without interruption between various support frame parts of the support frame and can thus form the main textile part as well as one or plural auxiliary units. Additional auxiliary units can be connected with the main textile part by a seam and can thus cause the desired tension reaction of the main textile part at the support frame. The connection of the auxiliary units at the main textile part thus defines the edge of the main textile part, wherein at least two auxiliary units of a respective auxiliary unit group extend from the edge to the support frame. Relative to the main textile part the auxiliary units are characterized in that the auxiliary units extend at a slant angle relative to the main textile part or relative to main textile surface of the main textile part, advantageously the auxiliary units extend at an opposite slant angle relative to the main textile surface of the main textile part. The single piece flat contexture which forms the main textile part and at least one auxiliary unit would be kinked in this embodiment at one location or would be run in a kink due to the tension rection by at least one additional auxiliary unit. The kink location or kink line defines the edge of the main textile part in this embodiment and thus the logical transition to the respective auxiliary unit which is also formed by the one-piece flat contexture. The kink or the kink line is generated by the tension reaction of the main textile part through the second auxiliary unit of the auxiliary group.

Analogously it is conceivable that the main textile part and all auxiliary units are formed by physically separate, advantageously textile parts which are then bonded together or connected by form locking. In case the auxiliary units are also formed by textile parts, the connection can be performed by sewing, welding, gluing or similar.

It is also conceivable that the auxiliary units of a respective auxiliary unit group are integrally formed in one piece by a textile part.

The auxiliary units differ functionally in that they connect the respective edge of the main textile part with different attachment locations of the support frame, this means they extend from the edge to various attachment locations. In particular the auxiliary units can be connected at various support frame parts of the support frame, so that the auxiliary units extend from the edge of the main textile part in different directions relative to the main textile surface. A respective configuration can also be derived from the embodiment provided infra. The respective attachment locations can differ from one another in particular in that they are positioned differently relative to a direction that is perpendicular to the main textile surface, e.g. they are arranged at different distances from the main textile surface measured perpendicular to the main textile surface. Accordingly it is particularly advantageous when the support frame elements that include the attachment locations are offset relative to each other in a direction perpendicular to the main textile surface, wherein the first auxiliary unit of the at least one auxiliary unit group is attached at a support frame part of the support frame and the second auxiliary unit of the same auxiliary unit group is attached at another support frame part of the support frame that is offset from the first support frame part. Advantageously the support frame parts are arranged relative to one another, so that the auxiliary units extend from the respective edge of the main textile part, where they are jointly connected, in different directions from the edge, advantageously in different directions inclined relative to the main textile surface. An embodiment is particularly advantageous where the support frame parts are arranged on different sides of the main textile surface so that the auxiliary units extend from the edge of the main textile part at opposite slant angles with respect to the main textile surface relative to their associated support frame parts.

It is also conceivable that an auxiliary unit includes a plurality of auxiliary elements respectively configured as a wire spring wherein a respective end of the auxiliary elements is connected at the support frame and a respective other end is connected with the at least one edge of the main textile part. The auxiliary units are jointly directly connected with an outer edge of the main textile part so that the main textile part is directly supported at the auxiliary units and thus supported by the auxiliary units at the support frame.

The connection of the auxiliary units with the main textile part is arranged at least along a section of a respective edge of the main textile part, advantageously along the entire edge of the main textile part. Advantageously the support of the respective edge of the main textile part can be provided by the auxiliary units, so that the connection of the main textile part with the support frame is performed overall exclusively by the auxiliary units, wherein the operating device can include in particular plural auxiliary unit groups, wherein plural auxiliary unit groups can be associated with the same edge and/or different edges of the main textile part. In this embodiment the main textile part is only indirectly connected with the support frame, this means without any direct connection of main textile part and support frame. It is also conceivable that the main textile part is only connected with the support frame by at least one auxiliary group in sections, e.g. along an edge or along a portion of the edge and directly attached at the support frame along other sections, e.g. along another edge.

According to a particularly advantageous embodiment the main textile part is attached at the support frame at least at two opposite edges by auxiliary unit groups, wherein a first auxiliary unit group is advantageously associated with the first edge and a second auxiliary unit group is associated with a second edge that is opposite to the first edge. Advantageously the operating device only includes exactly these two auxiliary unit groups. The remaining edges of the main textile part, in case of a rectangular main textile part, the two remaining edges, can be attached at the support frame directly or indirectly through auxiliary unit groups or not be connected at the support frame at all.

In this case, the at least two auxiliary units of the at least one auxiliary unit group jointly act at the at least one edge of the main textile part, so that the main textile part is connected at the respective edge through a joint action of all auxiliary units of the auxiliary unit group at the support frame and the auxiliary units accordingly act together. Therefore, a reaction of forces from the main textile part to the support frame is performed at least in areas where the support is provided by the auxiliary units as described supra, wherein all auxiliary units of the respective auxiliary unit group act jointly. The auxiliary unit groups are attached at the support frame at edges or ends oriented away from the main textile part.

The piece of sitting or lying furniture described supra has many advantages. In particular the type of support of the at least one edge of the main textile part described supra facilitates that the edge of the main textile part, advantageously plural edges or all edges of the main textile part are not supported at the support frame in a rigid manner when the main textile part of the piece of sitting or lying furniture is used by a user, but the edges can move within a certain clearance. This clearance is determined by the deformability of the auxiliary units. Thus, the auxiliary units like the main textile part have a certain elasticity which causes the auxiliary units to deform under force impact, in particular lengthen or stretch under tensile forces. Since the auxiliary units react forces at a respective edge as described supra the auxiliary units of the respective auxiliary unit group go through corresponding length extensions in a respective load direction. This causes the respective edge of the main textile to move under load in as far as the auxiliary units permit the movement through their respective elasticity. This movement of the edge of the main textile part where a user of the piece of sitting or lying furniture typically sits or lies or against which the user leans, facilitates that at least a portion of the detrimental hammock effect described supra is prevented.

In particular the main textile part is not hooked up at the support frame between opposite support frame parts of the support frame like in the prior art and thus does not form the prior art hammock. Instead, the edges of the main textile part are moveable in a vertical and a horizontal direction wherein the forces are reacted into the support frame at least partially, advantageously completely by the auxiliary units. This has the effect that the respective edge of the main textile part that cooperates with the auxiliary units can move and the effect of hooking the main textile part into the support frame is at least reduced. Thus, forces imparted by a user into the main textile part in a load case, this means e.g. the user sitting on the main textile part causes a lesser elevation difference between a center point of the main textile part and its respective edge relative to the prior art measured perpendicular to the main textile surface so that the uncomfortable sinking into the main textile part that happens in the prior art is reduced.

As a result the piece of sitting or lying furniture with its self-supporting main textile part is more comfortable for the user than prior art pieces of furniture. Thus, it is an object of the invention to raise the sitting or lying comfort of the user on a piece of sitting or lying furniture that uses self-supporting textile material to a level that is otherwise only reached by chairs or lounge chairs that are provided with padding. The function of the padding is to cushion forces impacting the body of the user, this means distributing the forces and thus improve the sitting or lying comfort for the user. In the piece of sitting or lying furniture according to the invention this effect is achieved without padding in that the contact surface between the main textile surface and the body of the user is reduced as describe supra and only covers portions of the body that are not perceived uncomfortable, e.g. the buttocks or the shoulders. Thus it is possible and advantageous to provide the piece of sitting or lying furniture without padding, in particular provide the operating device without padding.

The main textile part can be configured rectangular at least in a folded-out form. The folded-out form designates a form where the main textile part is not installed at the piece of sitting or lying furniture but placed on the ground ready to be installed in the piece of sitting or lying furniture, and in particular free from external forces. In a seating surface of an office chair that is formed by the operating device the self-supporting main textile part can have a rectangular almost square shape. The main textile part is thus advantageously configured so that its width and length differ at the most by the factor 3, advantageously by the factor of 2, further advantageously at the most by the factor of 1.5. Put differently, the main textile part is typically configured flat with essentially similar dimensions in the width and longitudinal direction. A rectangular or square main textile part according to the invention has a total of four defining circumferential edges.

Advantageously, the main textile part cooperates at least along opposite edges respectively with at least one auxiliary unit group, advantageously with exactly one auxiliary group per edge, wherein the auxiliary unit group includes respectively at least two auxiliary units so that the main textile part is indirectly supported at the support frame. In this embodiment it can be particularly advantageous when the auxiliary units act without interruption along the respectively associated edge, this means at each connection location where they are connected with the respective edge of the main textile part. This can be achieved in a particularly simple manner when the auxiliary units are respectively formed by strip shaped auxiliary textile parts that will be subsequently described in an advantageous embodiment.

When the main textile part cooperates at plural edges with a respective auxiliary unit group, e.g. advantageously at opposite edges, a first edge of the opposite edges of the main textile part cooperates with a first auxiliary element of a first auxiliary unit group and also with a second auxiliary element of the second auxiliary unit group and the second of the opposite edges of the main textile part cooperates with a first auxiliary element of a second auxiliary unit group as well as with a second auxiliary element of the second auxiliary unit group. Plural auxiliary unit groups can also be provided and/or at least one auxiliary unit group can include more than two auxiliary elements.

The individual auxiliary unit groups that are associated with different edges of the main textile part can advantageously cooperate mechanically. This will be described with reference to an embodiment described infra where opposite edges of a main textile part are respectively supported at a support frame by an auxiliary unit group respectively including two auxiliary units. The auxiliary units of the auxiliary unit groups thus jointly operate as a tension reaction element between the main textile part and the support frame, wherein the auxiliary unit groups mechanically cooperate at opposite edges and jointly provide tension reaction for the main textile part so that opposite edges of the main textile part are supported floating in a vertical and horizontal direction and not rigidly supported with an edge of the main textile part directly at the support frame, this means have the movement flexibility described supra. The tension reaction is thus advantageously performed so that the auxiliary units of the auxiliary unit groups are oriented at an angle relative to a main textile surface of the main textile part already in an unloaded condition, or at the latest in a condition where the operating device is loaded by a person. Advantageously the auxiliary units of a respective auxiliary unit group extend from the respective edge of the main textile part at opposite slant angles to their associated support frame parts with reference to the main textile surface.

In particular with respect to a piece of sitting furniture e.g. a chair it is conceivable that a support frame is arranged only laterally on the left side and laterally on the right side of the operating device in a front view of the piece of sitting furniture so that the operating device is only supported at the support frame along a left and right edge portion. The main textile part of the operating device is supported at the support frame e.g. along opposite lateral walls of the main textile part that are associated with corresponding lateral support frame parts of the support frame so that the main textile part is supported by two auxiliary unit groups at the support frame wherein one auxiliary unit group is associated with the one of the opposite edges of the main textile part. Thus, the main textile part is advantageously configured rectangular. The auxiliary units of the auxiliary unit groups can thus extend advantageously along an entire respective edge of the main textile part, wherein the auxiliary units are advantageously respectively jointly connected with the respective entire edge of the main textile part. The tension reaction recited supra of an edge of the main textile part by the auxiliary units is always performed in this embodiment by both auxiliary units of the respective auxiliary unit group jointly. The auxiliary units are thus advantageously oriented at a slant angle relative to a main textile surface of the main textile part, in particular at opposite slant angles so that a force acting perpendicular to the main textile surface can be reacted into the support frame particularly well by this tension reaction arrangement.

The support frame advantageously includes plural support frame elements, advantageously two support frame elements on each side of the operating device wherein the support frame elements run on different elevation levels. Thus, advantageously a first auxiliary unit of a respective auxiliary unit group is attached at a support frame part with an end of the first auxiliary unit oriented away from the main textile part and a second auxiliary unit of the same auxiliary unit group is attached at the other support frame part at an end of the second auxiliary unit that is oriented away from the main textile part. Thus, the auxiliary units of the auxiliary unit group are oriented respectively at opposite slant angles with respect to the main textile surface of the main textile part. Advantageously the one auxiliary unit can react the tension from the respective edge of the main textile part at a slant angle upward and the other auxiliary unit can react the tension from the edge at a slant angle downward. In this embodiment the support frame advantageously includes two support elements offset from one another at a side of the operating device associated with a respective edge of the main textile part, wherein the two support elements are arranged on opposite sides of the main textile surface defined by the main textile part.

Advantageously the at least one auxiliary unit group is arranged in at least one outer edge portion of the operating device. In particular in a case where the auxiliary units of the auxiliary unit group are formed by auxiliary textile parts as will be described infra it can be advantageous when the auxiliary units form at least an outer edge portion of the operating device.

Particularly advantageously the main textile part is exclusively supported at the support frame by auxiliary units of auxiliary unit groups, this means there is no direct connection between the main textile part and the support frame. In this embodiment at least all edge portions of the operating device that cooperate with the support frame are formed by auxiliary unit groups or their auxiliary units, or the auxiliary units are arranged in these edge portions. In this embodiment the main textile part is supported at the support frame in a particularly advantageous manner since the effect described supra of movability of the respectively supported edge of the main textile part is particularly pronounced due to the elastic support by the auxiliary units.

Additionally it can be advantageous when the support frame is configured in multiple components, this means formed in particular by a plurality of support frame components. In this embodiment the auxiliary units of the at least one auxiliary unit group are respectively attached at different support frame element, respectively at different support tubes of the of the support frame. This embodiment can be particularly advantageous in order to arrange the attachment locations with a specified distance from one another wherein the auxiliary units are arranged at the attachment locations at the support frame so that the auxiliary units can extend respectively at a relatively steep angle with respect to the main textile part or its main textile surface which renders the auxiliary units particularly suitable to react forces that impact the main textile part so that the forces are reacted into the support frame. Though it is conceivable as a matter of principle to provide attachment locations at a single piece support frame wherein the attachment locations are arranged at a significant distance from one another it is simpler to divide the support frame into plural support frame parts for this purpose. Advantageously the support frame parts are arranged relative to the main textile part so that the auxiliary units of the at least one auxiliary unit group extend with respect to the main textile surface from the edge of the main textile part in opposite slanted directions, upward at a slant angle and downward at a slant angle. The individual support frame parts are connected with one another in a force transferring manner in an operating condition of the piece of sitting or lying furniture.

In an embodiment of an office chair it is conceivable to configure the support frame at one side of the operating device with an upper support tube and a lower support tube on sides of the operating device configured as a sitting surface, wherein a first auxiliary unit of the at least one auxiliary unit group is attached at the upper support tube and a second auxiliary unit of the auxiliary unit group is attached at the lower support tube. The support tubes can be arranged above one another in this embodiment viewed in the vertical direction and have e.g. a vertically measured distance from one another of at least 3 cm, advantageously at least 4 cm, further advantageously at least 5 cm wherein the main textile surface of the main textile part extends approximately at a medium elevation level between the elevation levels of the two support tubes in a cross section perpendicular to the support tubes. Put differently the support tubes in this embodiment are arranged on different sides of the main textile surface of the main textile part, thus there above and there under. In this embodiment the two auxiliary units of the auxiliary unit group extend from the edge of the main textile part with reference to the main textile surface at opposite slant angles, namely the first auxiliary unit to the upper support tube at a slant angle upward and a second auxiliary unit to the lower support tube at a slant angle downward.

Accordingly the auxiliary units extend from the respective edge of the main textile part to different attachment locations of the support tube. The different attachment locations can be arranged in particular at different elevation levels with reference to a main textile surface of the main textile part, this means measured in a direction perpendicular to the main textile surface so that the auxiliary units extend from the edge of the main textile part at different angles with reference to the main textile part. Thus, the auxiliary units can be arranged at different support frame parts of the support frame, which are advantageously arranged offset from one another viewed in a direction perpendicular to the main textile surface of the main textile part, this means they can extend at different elevation levels with reference to the main textile part. Attaching the auxiliary units at different attachment locations of the support frame has the effect that the auxiliary units extend at different orientations towards the main textile part and are thus particularly well suited to react differently oriented forced components that impact the respective edge of the main textile part into the support frame. The attachment locations can be arranged advantageously at different sides of the main textile part.

In another advantageous embodiment the at least one edge of the main textile part that cooperates with the auxiliary units of the at least one auxiliary unit group can be configured reinforced. This reinforcement causes an increase in stiffness of the main textile part in a portion of the edge compared to a stiffness of the main textile part in the portion of the remaining textile main surface, wherein the stiffness in the portion of the edge exceeds the stiffness of the remaining textile surface advantageously at least by a factor of 2, further advantageously by a factor of 4. The reinforced configuration of the edge of the main textile part can be advantageous in order to reduce a deformation of the edge, e.g. when the edge is supported punctiform by at least one auxiliary element of one of the auxiliary units which accordingly improves force reaction into the auxiliary units and into the support frame.

In a particularly advantageous embodiment of the piece of sitting or lying furniture according to the invention, the auxiliary units of the at least one auxiliary unit group, advantageously the auxiliary units of all auxiliary unit groups are formed by auxiliary textile parts. Put differently, the auxiliary units in this embodiment are comparable to the main textile part of a flat contexture, e.g. a flat woven material, knitted material or warp knitted material. As a matter of principle it is conceivable that at least one of the auxiliary units is configured differently, e.g. with a plurality of individual auxiliary elements configured as individual spring elements or similar. The configuration of the auxiliary units in a form of auxiliary textile parts is, however, advantageous in order to attach the main textile part at the support frame. For example at least one auxiliary unit and the main textile part can be jointly formed by a one-piece integral flat element as described supra. In this embodiment, the main textile part transitions into the first auxiliary unit at an edge that is defined by the connection of the second auxiliary unit. Put differently, the flat contexture adjoins the second auxiliary unit, wherein the connection defines the edge of the main textile part from which the two auxiliary units extend, namely the first auxiliary unit which is also formed by the flat contexture which also forms the main textile part, and the second auxiliary unit which is separate from the flat contexture and is formed by another flat contexture. The second auxiliary element is coupled in a force transferring manner to the flat contexture, e.g. sewn therewith, glued, or welded thereto. This defines the edge of the main textile part.

A multi-layered embodiment is also conceivable where at least one auxiliary unit of at least one auxiliary unit group is formed by plural overlapping flat contextures which jointly form the respective auxiliary textile part according to the invention. In this multi-layer embodiment of an auxiliary textile part one layer can be formed by the flat contexture that also forms the main textile part. The flat contexture runs in this embodiment as described supra between opposite support frame elements of the support frame and thus forms the main textile part as well as a layer of a multi-layer auxiliary textile part. The second layer of the auxiliary textile part can thus be formed by a separate flat contexture.

The subsequent described advantageous embodiments of the piece of seating or lying furniture refer to an embodiment where the auxiliary units of the at least one auxiliary unit group are respectively formed by auxiliary textiles.

In the described embodiment the auxiliary units formed as the auxiliary textile parts are advantageously configured flat and accordingly have a respective length and a respective width. In a manner comparable to the main textile part the length and the width respectively exceed a thickness of the respective auxiliary unit so that the auxiliary units are respectively configured as flat contextures. Advantageously the auxiliary textile parts can have a rectangular shape. The auxiliary units are arranged so that the auxiliary textile surfaces of the auxiliary units extend at a slant angle relative to the main textile surface in a cross section perpendicular to a main textile surface of the main textile, advantageously in opposite slant directions relative to the main textile surface. Put differently, the main textile surface of the main textile part and the auxiliary textile surface of the auxiliary units are not arranged in parallel with one another. By the same token the auxiliary textile surfaces of the auxiliary units are not arranged parallel to each other.

In this embodiment the auxiliary units of the at least one auxiliary unit group can absorb forces from a respective edge of the main textile part at which the auxiliary units are connected, e.g. sewn, glued, or welded and can react the force vectors to the support frame. When a first auxiliary unit is oriented at an upward slant angle with its auxiliary textile surface relative to the main textile surface the first auxiliary unit is particularly well suited to react forces in a vertical direction relative to the main textile surface forming tension forces and react these tension forces into the support frame. The second auxiliary unit which is advantageously inclined at a downward slant angle relative to the main textile surface helps in this embodiment to fix the respective edge of the main textile part in a horizontal direction in cross section so that the main textile part does not form a slumping hammock shaped operating surface together with the first auxiliary unit as known from the prior art which would cause the detrimental hammock effect described supra.

The designation of the direction of the auxiliary units relative to the main textile surface, thus upward and downward is oriented according to the instant application relative to a main loading direction of the operating device when used as intended. The main load direction is typically oriented perpendicular to the main textile surface. Upward according to the invention designates a direction that is inclined towards the side of the main textile part that is impacted by the respective force or the direction from which the force comes. Accordingly downward according to the instant application is inclined towards the other side of the main textile part which is oriented away from the side of the main textile part that is impacted by the force. For example, an operating device that forms the seating surface of a chair is impacted by a force upon the main textile part that is vertically oriented top down when used as intended.

Thus, the auxiliary units jointly provide the intended floating support of the respective edge of the main textile part which helps to achieve the improved sitting and lying comfort of the piece of sitting or lying furniture. The advantageous orientation of the auxiliary textile surfaces sloped in different directions relative to the main textile surface therefore has the effect of a slanted tension force reaction of the respective edge of the main textile part into the support frame. In an embodiment of a main textile part that is respectively supported at opposite edges by an auxiliary textile group the supported width that is covered by the main textile part only extends between edges of the main textile part and not between the respective support frame parts of the support frame. The supported width is thus reduced which reduces the bending and maximum deflection of the bending line of the main textile part.

In order to further improve support of the at least one edge of the main textile part it is advantageous when the auxiliary units are jointly connected with the main textile part at each connection location of the at least one edge. In this embodiment the respective edge is supported by the auxiliary units of the respective auxiliary unit group without interruption, so that a force reaction from the main textile part through the auxiliary units to the support frame along the edge is made more even so that local distortions and stress peaks in the main textile part are avoided.

In another advantageous embodiment at least one of the auxiliary units of the at least one auxiliary unit group is configured strip shaped. Thus, one long side of the respective auxiliary unit extends locally parallel with respect to the edge of the main textile part that the auxiliary unit is connect to. Even more advantageously, the auxiliary units of all auxiliary unit groups are configured strip shaped. Strip shaped auxiliary units can extend along the entire respective edge of the main textile unit in a particularly simple manner when the auxiliary units are connected with the edge of the main textile part.

In this embodiment it is feasible in a particularly simple manner to support the respective edge of the main textile part without interruption using the auxiliary units, so that any location of the respective edge forms a connection location where the edge is connected with the support locations. A correspondingly large length of the strips helps to avoid punctiform force peaks when introducing force into the main textile part and an even load distribution is achieved. Since the auxiliary units advantageously only form an edge portion of the operating device as described supra this edge portion only has to be bridged in order to react forces from the edge of the main textile part to the support frame. Accordingly, a width of the respective auxiliary unit which is configured strip shaped as described supra is typically significantly smaller than its length measured parallel to the respective edge of the main textile part. This combination of a great length with a rather small width yields the described strip shape which can also be designated as rectangular.

When at least one of the auxiliary units is configured strip shaped a width of the respective auxiliary unit compared to a length of the auxiliary unit is significantly smaller, wherein the width of the auxiliary unit is smaller than the length by at least a factor of 4, advantageously at least by a factor of 6, further advantageously at least by a factor of 10. The width is measured between a respective connection location of the at least one edge of the main textile part measured to the most proximal attachment location of the respective auxiliary unit at the carrier frame. Relative to the long side of the auxiliary unit which extends parallel to the respective edge of the main textile part, the transversal side is at least essentially oriented perpendicular to the edge, wherein the length of the auxiliary unit is measured parallel to the long side and the width of the auxiliary unit is measured parallel to the transversal side.

In a particularly advantageous embodiment at least the main textile part, advantageously additionally at least one of the auxiliary units, further advantageously all auxiliary units are formed by a woven material, knitted material or a wrap knitted material. These embodiments are particularly advantageous for the configuration of the main textile part and the auxiliary units with respect to technical utility as well as achieved user comfort.

In another advantageous embodiment a tensile stiffness of the main textile part is smaller than a tensile stiffness of at least one of the auxiliary units. It can be particularly advantageous when the tension stiffness of the main textile part is smaller than the tension stiffness of the auxiliary unit, which is oriented downward sloped with the auxiliary textile surface relative to the main textile surface as described supra. Advantageously the tension stiffness of the main textile part is smaller than the tension stiffness of all auxiliary units. This embodiment has proven particularly advantageous for reacting forces from the main textile part through the auxiliary units into the support frame.

Furthermore it can be particularly advantageous when the tension stiffness of the auxiliary units is different, wherein the tension stiffness of the first auxiliary unit extending at an upward slant angle relative to the main textile surface is greater than the tension stiffness of the second auxiliary unit extending at a downward slant angle relative to the main textile surface. This combination has also proven advantageous for supporting the main textile part.

Furthermore it can be particularly advantageous when the main textile part and/or at least one of the auxiliary units, advantageously all auxiliary units are provided heat shrinking or have heat shrinking properties. The recited components can be e.g. respectively formed by a heat shrinkable fabric that includes at least one heat shrinkable yarn. In this embodiment the operating device can be taunted in a particularly simple manner after being arranged at the support frame by applying thermal energy so that the operating device is overall wrinkle free and has a particular preload which improves force reaction into the support frame in particular in view of the self-supporting properties of the operating device, in particular of the main textile part. In particular the deformation of the operating device under force impact is smaller after the preloading. This can be particularly advantageous for user comfort of the piece of sitting or lying furniture. Furthermore an embodiment is particularly advantageous where the main textile part and/or at least one of the auxiliary units advantageously all auxiliary units are elastic, advantageously formed by an elastic fabric. Elastic according to the instant invention means that the respective part has an elongation of at least 2%, e.g. 2.5% or 3% without developing plastic, this means remaining deformation. Put differently, this part can spring back into its original condition even under strong deformation in loaded condition as soon as the force impact is removed.

Independently from the configuration of at least one textile part with heat shrinking and/or elastic properties it can be advantageous as a matter of principle when the main textile part or at least one of the auxiliary units is preloaded. This can be performed e.g. in that the respective part is installed at the respective piece of sitting or lying furniture in an expanded or stretched condition.

Last not least it is advantageous when the auxiliary textile surfaces of the auxiliary units of the at least one auxiliary unit group enclose an angle between 5° and 90°, advantageously between 25° and 85°, further advantageously between 40° and 80° between the at least one edge of the main textile part and the main textile surface of the main textile part. Thus, the auxiliary units are oriented at opposite slant angles, advantageously with reference to the main textile surface, this means an auxiliary unit is oriented at the recited angle slanted away from the one side of the main textile part and the other auxiliary unit is oriented in the opposite direction under the recited slant angle away from the other side of the main textile part. This is defined according to the invention as an extension of the auxiliary units at opposite slant angles with reference to the main textile surface. The recited angular dimensions have the effect that a reaction of forces from the respective edge of the main textile part to the support frame through the auxiliary units is performed particularly well. If these auxiliary units were arranged too flat, this means the angle is too small, the resulting forces in the auxiliary units would be excessively large in order to react vector portions that act perpendicular to the main textile surface into the support frame. This is prevented by a respectively pronounced inclination of the auxiliary units relative to the main textile surface so that the main textile part can be supported by the auxiliary units at the support frame in the desired manner.

BRIEF DESCRIPTION OF THE DRAWINGS

The invention is now described based on advantageous embodiments with reference to drawing figures, wherein.

DETAILED DESCRIPTION OF THE INVENTION

Figure 1:
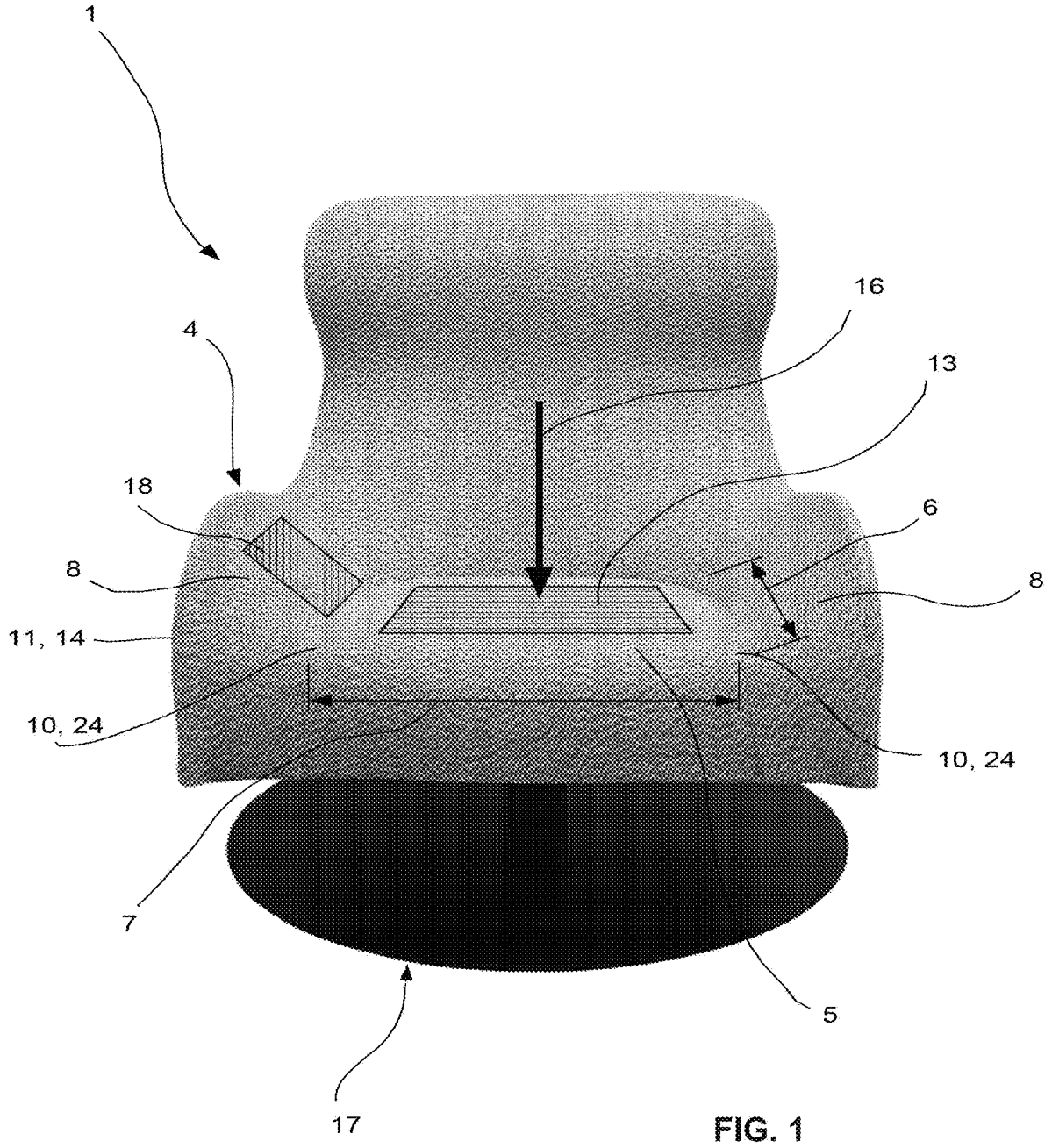
FIG. 1 illustrates a perspective view of a piece of sitting furniture according to the invention.
Figure 2:
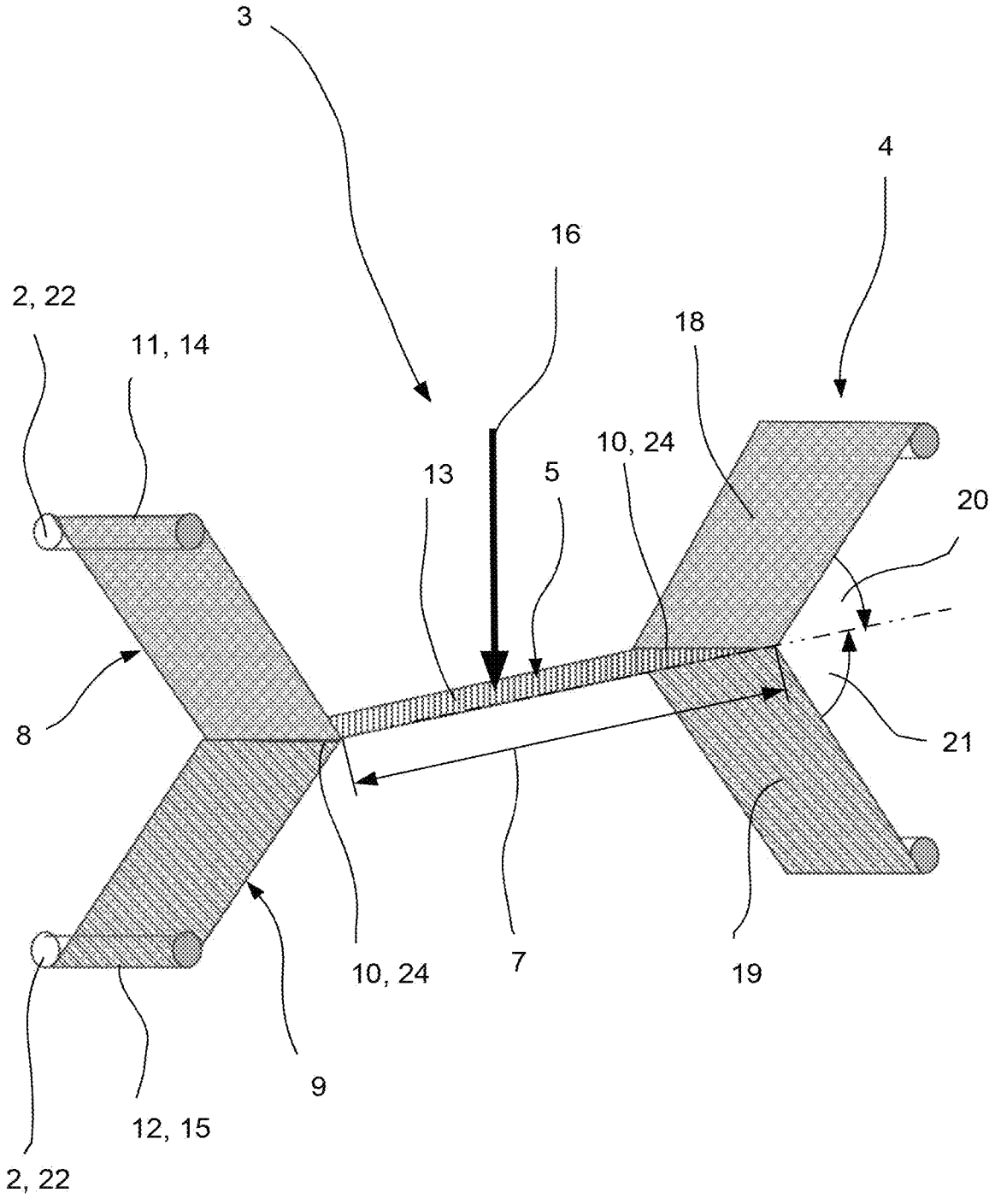
FIG. 2 illustrates a schematic view of an operating device of the piece of sitting furniture according to FIG. 1 supported at a support frame of the piece of sitting furniture according to FIG. 1.

An embodiment illustrated in FIGS. 1 and 2 relates to a piece of sitting or lying furniture 1 according to the invention which is configured as a piece of sitting furniture configured as an office chair. The piece of sitting furniture 1 includes a support frame 2 and an operating device 3. The operating device 3 is for a user of the piece of sitting furniture to sit on. Therefore the operating device 3 in the illustrated embodiment forms a sitting surface of the piece of sitting furniture which is an arm chair in this embodiment. The piece of sitting furniture includes a standing base 17 that sits on the ground.

As evident from the schematic view of FIG. 2 the operating device 3 includes a main textile part 5 and two auxiliary unit groups 4 respectively including two auxiliary units 8, 9. The main textile part is formed by a heat shrinkable flexible fabric having a rectangular shape with a total of four edges 10 in this embodiment. Thus, a length 6 and a width 7 of the main textile part 5 substantially exceed its thickness. In the illustrated embodiment the width of the main textile part 5 is approximately 50 cm, whereas the length 6 is approximately 45 cm. The thickness of the main textile part 5 corresponds to a thickness of a fabric forming the main textile part 5. Thus, the thickness in the illustrated embodiment is only a few millimeters.

The main textile part 5 is configured self-supporting. This means that a force 16 impacting the main textile part 5 is reacted towards the support frame exclusively by the main textile part 5 itself. Consequently the operating device 3 is free from support structures or similar in the portion of the main textile part 5, wherein the support structures would help a force reaction towards the support frame 2. Instead, forces 16 that impact a main textile surface 13 of the main textile part 5, in particular forces 16 that act in a direction perpendicular to the main textile surface 13 are exclusively reacted in that tension is formed in the main textile part 5 and the resulting force is reacted to edges 10 of the main textile part 5. Since the main textile part 5 has a rectangular shape it includes a total of four edges 10 in the illustrated embodiment.

In the illustrated embodiment the main textile part 5 is indirectly supported at the carrier frame 2, namely by the auxiliary units 8, 9 of the auxiliary groups 4. The auxiliary units 8, 9 for respectively formed by auxiliary textile parts in the illustrated embodiment wherein the auxiliary textile parts are made from textile flat elements. In the illustrated embodiment the auxiliary unit groups 4 are associated with a total of 3 edges 10 of the main textile part 5 wherein the edges 10 are respectively connected with an auxiliary unit group 4 including two auxiliary units 8. 9. FIG. 1 respectively only shows an upper auxiliary unit 8 since the associated lower auxiliary unit 9 is optically covered. The detail of FIG. 2 only shows two opposite edges 10 in order to describe the principle of the invention.

Figure 3:
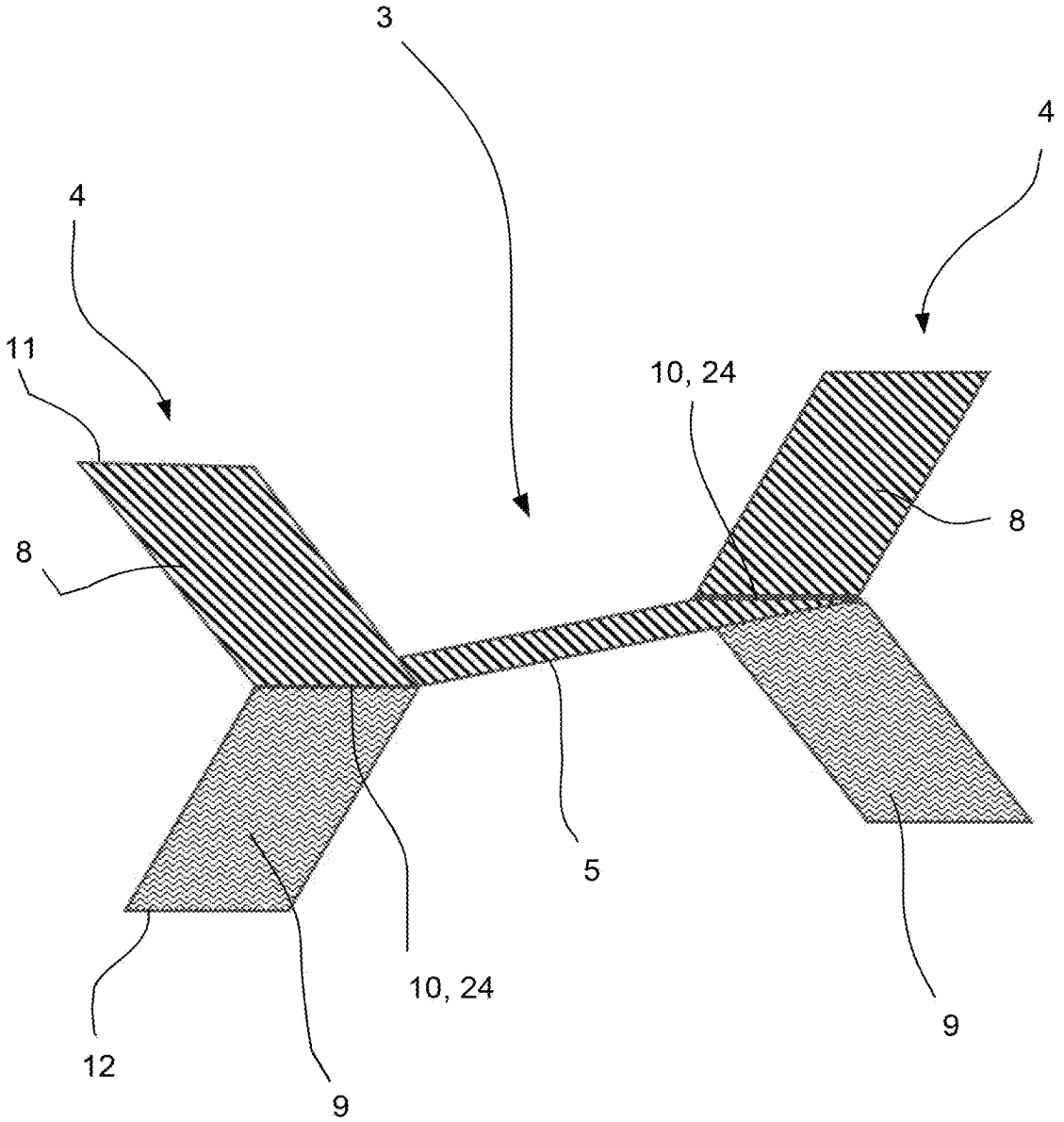
FIG. 3 illustrates a schematic view of an alternative operating device where a main textile part and plural auxiliary units are formed by a single piece flat contexture.

The auxiliary units 8, 9 are advantageously formed as flat contextures. They form edge portions of the operating device 3. With reference to FIG. 3 opposite edges 10 of the main textile part 5 respectively cooperate with an auxiliary unit group 4 respectively including two auxiliary units 8, 9. Overall, the operating device 3 is attached at three edges at the support frame 2, whereas a front edge of the operating device 3 is directly attached at the support frame 2. A reaction of forces 16 impacting the operating device 3 performed through the auxiliary unit groups 4 is run to the respective sides where the operating device 3 is connected with the support frame 2. In the illustrated embodiment the auxiliary units 8, 9 respectively include one auxiliary element wherein the auxiliary elements are respectively formed by the described flat auxiliary textile part.

The auxiliary units 8, 9 are continuously connected at a respective edge 10 of the main textile part so that a reaction of forces from the main textile part 5 to the auxiliary units 8, 9 can be performed along the entire respective edge 10 of the main textile part 5. The auxiliary units 8, 9 react the forces into the support frame 2 in that the auxiliary units 8, 9 are attached at their edges 11, 12 at the carrier frame 2 wherein the edges 11, 12 are oriented away from the respective edge 10 of the main textile part 5. Consequently the main textile units 8, 9 are directly attached at the support frame 2, whereas the main textile part 5 is only indirectly attached at the support frame 2 by the auxiliary units 8, 9. Thus, the auxiliary units 8, 9 extend from the edge 10 respectively to different attachment locations 14, 15 at the support frame 2, wherein the auxiliary units 8, 9 are attached line shaped along their outer edges 11, 12 at the support frame 2. The attachment locations 14, 15 are advantageously arranged at different carrier frame parts of the carrier frame 2 as will be described infra, wherein the carrier frame parts 22 are arranged at different sides of the main textile part 5 with reference to the main textile surface 13, so that the attachment locations 14, 15 are positioned differently viewed perpendicular to the main textile surface 13.

The auxiliary units 8, 9 cooperate with the main textile part 5 at each connection location 24 where they are connected with the respective edge of the main textile part 5. This means that both auxiliary units 8, 9 are connected with the edge 10 of the main textile part 5 at each connection location 24 where the respective edge 10 of the main textile part 5 is supported by a respective auxiliary unit group. Thus, the auxiliary units 8, 9 jointly form a respective auxiliary unit group 4 and jointly react forces from the main textile part 5 into the support frame 2. The support of the main textile part 5 along opposite edges 10 by two auxiliary unit groups 4 facilitates that the auxiliary units 8, 9 provide a tension reaction for the main textile part 5 at the respective edges 10 of the main textile part 5.

In order to facilitate this the auxiliary units 8, 9 are inclined in opposite directions with reference to the main textile surface 13 of the main textile part 5, this means they extend at opposite slant angles from the associated edge 10 with reference to the main textile surface 13. This means that the auxiliary textile surfaces 18, 19 of the auxiliary units 8, 9 respectively enclose an angle 20, 21 with the main textile surface 13 of the main textile part 5. This is performed in the illustrated embodiment in that the first auxiliary unit 8 extends relative to the at essentially horizontally oriented main textile surface 13 from the respective edge 10 at a slant angle upward, wherein the angle 20 enclosed by the auxiliary textile surface 18 of the first auxiliary unit 8 with the main textile surface 13 is approximately 40° in the illustrated embodiment. Analogously the second auxiliary unit 9 of the same auxiliary unit group 4 extends relative to the main textile part 5 at a slant angle downward, wherein the angle 21 between the auxiliary textile surface 19 of the second auxiliary unit 9 and the auxiliary textile surface 13 is also approximately 40° in the illustrated embodiment. The auxiliary units 8, 9 are advantageously attached at different support frame parts 22 of the support frame 2, wherein the support frame parts 22 are arranged vertically above one another and are arranged on different sides of the main textile surface 13 of the main textile part 5. The support frame parts 22 are advantageously formed herein by support tubes. The support frame parts 22 are connected with one another in a force transferring manner.

This way the respective edge 10 of the main textile part 5 that is operatively connected with the auxiliary units 8, 9 is tension reacted towards the support frame 2, wherein portions of the force 16 impacting the operating device 3 perpendicular to the main textile surface 13 can be reacted into the support frame 2 particularly well by the differently oriented auxiliary units 8, 9. This, however, maintains a certain movability or the described movement clearance of the edge 10 of the main textile part 5. Due to the length changes of the auxiliary units 8, 9 that occurs as a matter of principle due to the force reaction into the support frame 2, the edge 10 of the main textile part 5 is not rigidly fixed as would the be case for a direct attachment at a support frame 2. Accordingly, sitting comfort is improved over known pieces of sitting or lying furniture.

A reaction of forces 16 that impact the operating device 2 wherein the forces are reacted towards the support frame 2 is subsequently described based on an embodiment. The operating device 3 is loaded with a force 16 in a portion of its horizontally oriented main textile part 5, wherein the force acts perpendicular to the main textile surface 13 of the main textile part 5. For example, a user sits on the operating device 3 configured as a sitting surface. This type of loading has the effect that the main textile part 5 deforms and bends between its edges supported by the auxiliary unit pairs 4. Thus, the main textile part 5 expands and forms an approximately parabolic bending line between opposite edges 10. According to the description provided supra, the edges 10 are indirectly supported at the support frame 2 by the auxiliary units 8, 9 of the respectively associated auxiliary unit groups 4, wherein one of the opposite edges 10 cooperates with a first auxiliary unit 8 as well as with a second auxiliary unit 9 of a first auxiliary unit group 4 and the other of the opposite edges 10 cooperates with a first auxiliary unit 8 and a with a second auxiliary unit 9 of the second auxiliary unit group 4. The auxiliary units 8 and 9 are advantageously formed by strip shaped auxiliary textile parts.

Due to the force impacting the main textile part 5 opposite edges 10 of the main textile part 5 tend to move downward and towards one another. This movement is prevented by the tension reaction of the edges 10 through the auxiliary units 8, 9 towards the support frame 2, wherein the force 16 impacting the main textile part 5 is reacted into the auxiliary units 8, 9 and from there into the support frame 2. The first auxiliary units 8 oriented at a slant angle upward of the two auxiliary unit groups 4 greatly contribute to react the force into the upper support frame parts 22 of the support frame 2 wherein the force initially acts perpendicular to the main textile surface 13.

Without the second auxiliary unit 9, the operating device 3 would hook in a known manner in a parabola shape between the respective upper support frame parts 22 of the support frame 2 and cause the described hammock effect. This, however, is prevented by the second auxiliary units 9 which tension relief the respective edges 10 of the main textile part 5 in the horizontal direction and at a slant angle downward at the support frame 2, namely at the lower support frame parts 22 and thus support the edges 10 in this way. Due to the elastic deformation of the auxiliary units 8, 9 a loading of the operating device 3 causes a movement of the edges 10 in the three-dimensional space. This movement, however, only occurs with in a certain range that is defined by the elongation stiffness of the auxiliary units 8, 9 and of the main textile part 5. In particular the edges 10 of the main textile part 5 cannot move freely in cooperation with the first auxiliary units 8, so that a kink is established in the presence of a force impacting the operating device at a transition from the main textile part 5 to the auxiliary units 8, 9. The support width over which the main textile part 5 reacts the force to the left and to the right in a direction towards the support frame 2 therefore is smaller than for a direct support of the main textile part 5 at the support frame 2. Accordingly a bending of the main textile part 5 caused by the force is smaller than in the prior art which yields the advantages described supra with respect to increased sitting comfort of the piece of sitting furniture.

Advantageously tensile stiffness of the main textile part 5 and of the auxiliary units 8, 9 differs. For example it is conceivable that all parts, for example the main textile part 5 and the respective auxiliary units 8, 9 are formed by separate or different flat contextures which can be configured in different manners. The main textile part 5 and the auxiliary units 8, 9 in this embodiment can be sewed or welded together wherein the auxiliary units 8, 9 are connected at the respective edge 10 of the main textile part 5. It can be particularly advantageous when the tensile stiffness of the main textile part 5 is smaller than the tensile stiffness of the auxiliary units 8, 9.

As evident from FIG. 3 it is also conceivable that the main textile part 5 and the respective first auxiliary units 8 of the two auxiliary unit groups 4 are jointly formed by a single piece flat contexture. This flat contexture is directly attached at the support frame 2 at outer edges 11 of the first auxiliary units 8. The transition from the main textile part 5 to the auxiliary units 8 is caused by the connection of the second auxiliary units 9 of the two auxiliary unit groups 4 at the flat contexture that forms the main textile part 5 and the first auxiliary units 8. The edges 10 of the main textile part 5 are formed along the lines where the second auxiliary units 9 are connected with the flat contexture, e.g. by sewing, gluing, or welding and form a typical kink at the transition from the main textile part 5 to the auxiliary units 8, 9 due to the tension relief. As a result, the auxiliary units 8, 9 with their auxiliary textile surfaces 18, 19 are oriented at a slant angle 20, 21 relative to the main textile surface of the main textile part 5, wherein the first auxiliary units 8 are sloped upward from the edge 10 and the second auxiliary units 9 are sloped downward from the edge 10 and are attached at their edges 11, 12 oriented away from the main textile part 5 at support frame parts 22 of the support frame.

Figure 4:
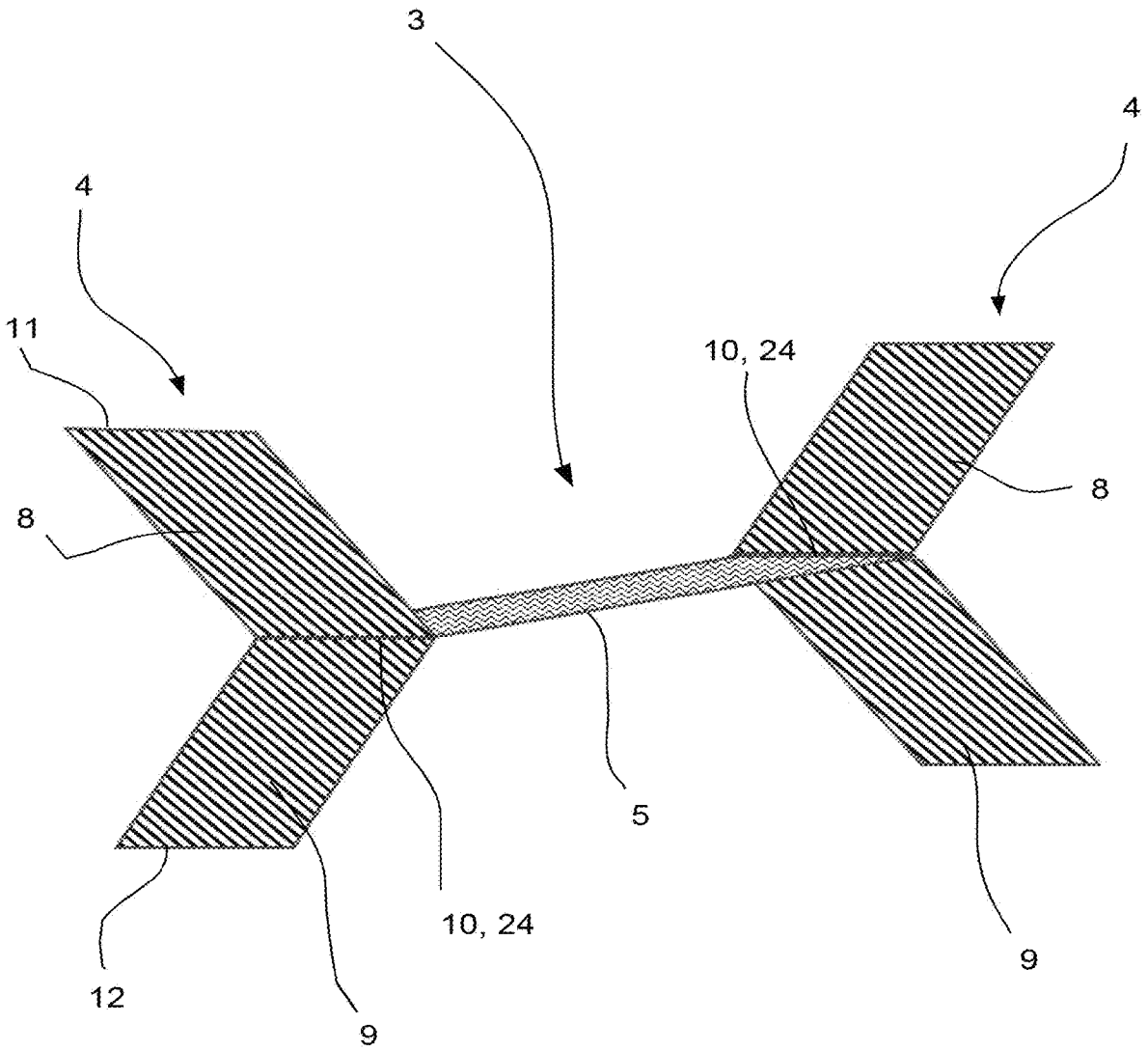
FIG. 4 illustrates a schematic view of an alternative operating device where plural auxiliary units of an auxiliary unit group are formed by a single piece flat contexture.

Another advantageous embodiment illustrated in FIG. 4 shows auxiliary units 8, 9 of a respective auxiliary unit group 4 formed by a single piece flat contexture. The transition from one auxiliary unit 8, 9 to another auxiliary unit 8, 9 is defined by the connection with the main textile part 5, wherein the flat contexture is e.g. sewed together or welded together with the main textile part 5.

Figure 5:
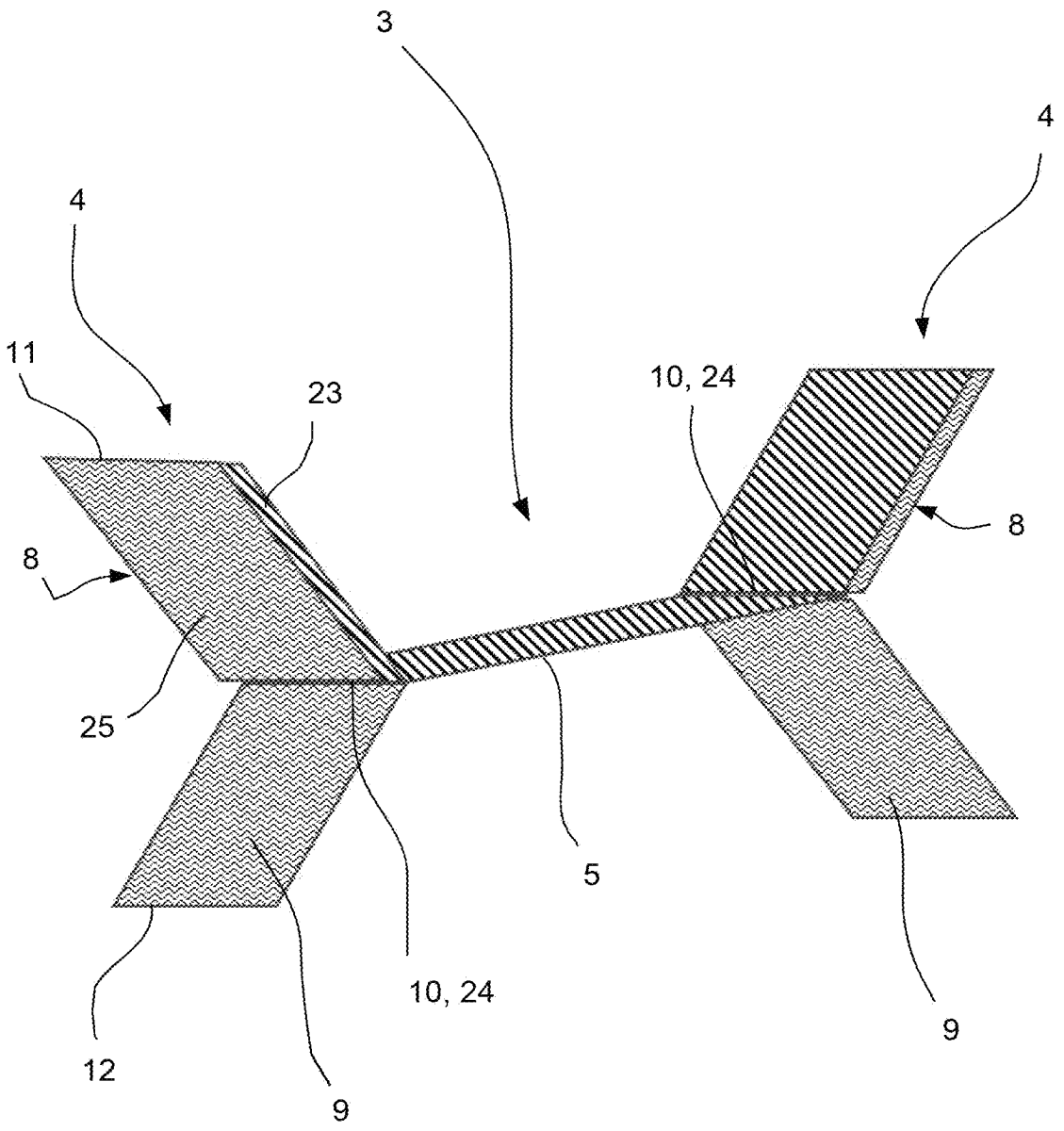
FIG. 5 illustrates a schematic view of an alternative operating device where several auxiliary units are formed by multi-layer auxiliary textile parts.

It is also conceivable that individual auxiliary units 8, 9 are configured with different layers. In the embodiment illustrated in FIG. 5 the first auxiliary units 8 of the auxiliary unit groups 4 are respectively formed with two layers, respectively including a first single piece flat contexture 25 and a portion of a second flat contexture 23, which also forms the main textile part 5. Therefore the second flat contexture 23 as described with reference to FIG. 3 runs between the upper support frame parts 22 of the support frame 2 and thus forms a portion of the auxiliary units 8 as well as the main textile part 5. The auxiliary units 8 respectively additionally include the first flat contexture 25, wherein the flat contextures 23, 25 are arranged overlapping which creates the two-layer configuration. This embodiment facilitates adjusting desired tensile stiffness conditions and ratios between the main textile part 5 and the auxiliary units 8, 9 in a particularly simple manner. The two flat contextures 23, 25 can be connected with one another, in particular glued together, sewn together or welded together.

REFERENCE NUMERALS AND DESIGNATIONS

1 piece of sitting or lying furniture
2 support frame
3 operating device
4 auxiliary unit group
5 main textile part
6 length
7 width
8 auxiliary unit
9 auxiliary unit
10 edge
11 edge
12 edge
13 main textile surface
14 attachment location
15 attachment location
16 force
17 standing base
18 auxiliary textile surface
19 auxiliary textile surface
20 angle
21 angle
22 support frame part
23 flat contexture
24 connection location
25 flat contexture

What is claimed is:

1. A piece of sitting or lying furniture, comprising:

a support frame;

an operating device configured for a user to sit on, lie on or lean against, wherein the operating device includes a self-supporting main textile part configured to react forces imparted upon the operating device into the support frame self-acting by tensions formed in the main textile part, wherein the main textile part is configured as a flat contexture, wherein the operating device includes at least one auxiliary unit group including at least two auxiliary units which are directly and jointly connected with at least one edge of the main textile part at least in sections, so that the main textile part is directly supported at the at least two auxiliary units, wherein the at least two auxiliary units are attached at the support frame so that the main textile part is indirectly supported by the at least two auxiliary units at the support frame, wherein the at least two auxiliary units run from the at least one edge of the main textile part to different attachment locations at the support frame, wherein the at least one edge of the main textile part includes at least two edges, wherein the at least one auxiliary unit group includes two auxiliary unit groups wherein the main textile part cooperates at least along opposite edges of the at least two edges respectively with the at least one auxiliary unit group, wherein a first edge of the opposite edges of the main textile part cooperates with an auxiliary unit of a first auxiliary unit group of the at least two auxiliary unit groups and with a second auxiliary unit of the first auxiliary unit group and a second edge of the opposite edges of the main textile part cooperates with a first auxiliary unit of a second auxiliary unit group of the at least two auxiliary unit groups and with a second auxiliary unit of the second auxiliary unit group of the at least two auxiliary unit groups.

2. The piece of sitting or lying furniture according to claim 1, wherein the at least two auxiliary units form at least an outer edge portion of the operating device or are arranged in at least one outer edge portion of the operating device.

3. The piece of sitting or lying furniture according to claim 1, wherein the support frame is configured from different support frame parts, so that the at least two auxiliary units of the at least one auxiliary unit group are respectively attached at the different support frame parts.

4. The piece of sitting or lying furniture according to claim 1, wherein the at least two auxiliary units of the at least one auxiliary unit group are respectively formed by flat auxiliary contextures, and wherein auxiliary textile surfaces of the at least two auxiliary units are arranged at opposite slant angles starting from the at least one edge of the main textile part and measured relative to the main textile surface in a cross section perpendicular to a main textile surface of the main textile part.

5. The piece of sitting or lying furniture according to claim 4, wherein the at least two auxiliary units act jointly at each connection location of the at least one edge of the main textile part where the at least two auxiliary units are connected with the main textile part.

6. The piece of sitting or lying furniture according to claim 4, wherein at least the main textile part, and at least one of the at least two auxiliary units is formed by a woven material, knitted material or warp knitted material.

7. The piece of sitting or lying furniture according to claim 4, wherein the main textile part and at least one auxiliary unit of the at least two auxiliary units of the at least one auxiliary group, or the main textile part and plural similar auxiliary units of different auxiliary unit groups of the at least one auxiliary unit group are formed by a single piece of flat contexture.

8. The piece of sitting or lying furniture according to claim 4, wherein the at least two auxiliary units of the at least one auxiliary unit group are formed by a single piece flat contexture.

9. The piece of sitting or lying furniture according to claim 4, wherein the main textile part and all the auxiliary units of all the auxiliary unit groups are respectively formed by separate flat contextures, and wherein the main textile part and all the auxiliary units are sewn together or welded together.

10. The piece of sitting or lying furniture according to claim 4, wherein a tensile stiffness of the main textile part is smaller than a tensile stiffness of at least one auxiliary unit of the at least two auxiliary units of the at least one auxiliary unit group, or greater than a tensile stiffnesses of all auxiliary units.

11. The piece of sitting or lying furniture according to claim 4, wherein a tensile stiffnesses of the at least two auxiliary units of the at least one auxiliary unit group are different, and wherein a tensile stiffness of a first auxiliary unit of the at least two auxiliary units that extends upward at a slant angle relative to the main textile surface is greater than a tensile stiffness of a second auxiliary unit of the at least two auxiliary units that extends downward at a downward slant angle relative to the main textile surface.

12. The piece of sitting or lying furniture according to claim 4, wherein the main textile part and/or at least one auxiliary unit of the at least two auxiliary units of the at least one auxiliary unit group is configured with heat shrinking properties or formed by a heat shrinkable fabric.

13. The piece of sitting or lying furniture according to claim 4, wherein an angle enclosed by auxiliary textile surfaces of the at least two auxiliary units of the at least one auxiliary unit group and the main textile surface at the at least one edge of the main textile part is between 5° and 90°, or between 25° and 85° degrees, or between 40° and 80°.

14. The piece of sitting or lying furniture according to claim 4, wherein the main textile part and/or at least one auxiliary unit of the at least two auxiliary units of the at least one auxiliary unit group is formed by an elastic textile material capable of elastically absorbing elongations of at least 2% or at least 2.5% or at least 3%.

* * * * *